US006321403B1

(12) United States Patent
Matthews

(10) Patent No.: US 6,321,403 B1
(45) Date of Patent: Nov. 27, 2001

(54) PRESSURE RELIEF PILLOW AND METHODS

(75) Inventor: Susan H. Matthews, Evergreen, CO (US)

(73) Assignee: Camp Kazoo, Ltd., Golden, CO (US)

( * ) Notice: Subject to any disclaimer, the term of this patent is extended or adjusted under 35 U.S.C. 154(b) by 0 days.

(21) Appl. No.: 09/662,935

(22) Filed: Sep. 15, 2000

(51) Int. Cl.[7] ..... A47C 20/00; A47D 13/08
(52) U.S. Cl. ..... 5/655; 5/637; 5/644
(58) Field of Search ..... 5/636, 637, 638, 5/644, 655, 652.1, 733

(56) References Cited

U.S. PATENT DOCUMENTS

| | | | | |
|---|---|---|---|---|
| 3,848,281 | * | 11/1974 | Mathews | 5/636 |
| 4,383,713 | * | 5/1983 | Roston | 5/655 |
| 4,434,513 | | 3/1984 | Welch . | |
| 4,768,246 | * | 9/1988 | Summer | 5/637 |
| 5,048,136 | * | 9/1991 | Popitz | 5/655 |
| 5,056,533 | * | 10/1991 | Solano | 5/655 |
| 5,261,134 | | 11/1993 | Matthews . | |
| 5,546,620 | * | 8/1996 | Matthews | 5/655 |
| 5,586,351 | * | 12/1996 | Ive | 5/655 |
| 5,661,861 | | 9/1997 | Matthews . | |
| 5,978,981 | * | 11/1999 | Dunne et al. | 5/655 |
| 6,038,720 | | 3/2000 | Matthews et al. . | |
| 6,052,850 | * | 4/2000 | Salido et al. | 5/655 |
| 6,055,687 | | 5/2000 | Matthews . | |
| 6,119,873 | | 9/2000 | Matthews . | |

OTHER PUBLICATIONS

Heads Up, Gold Bug, 1998.
Nojo Double Head Support, Crown Crafts Infant Products, 1999.
Graco, All–in–One Infant Support, Graco Children's Products Inc., 2000.
Infant Head Rest, Kidsline.

* cited by examiner

*Primary Examiner*—Michael F. Trettel
(74) *Attorney, Agent, or Firm*—Townsend and Townsend and Crew LLP

(57) ABSTRACT

A support pillow for supporting a head or a person when in a supine position comprises a cushion member having a support region at least partially surrounding a pressure relief region. The support region is configured to support at least a portion of a head, and the pressure relief region is configured to receive at least a portion of a back side of the head such that pressure applied to the back side of the head is reduced when lying in a supine position.

21 Claims, 9 Drawing Sheets

PRESSURE RELIEF PILLOW AND METHODS

BACKGROUND OF THE INVENTION

The invention relates generally to the field of support pillows. In particular, the invention relates to pillows for supporting the head of an infant when reclining in a supine position, and to methods of supporting the infant's head when so reclining.

Medical advice now suggests that infants should be placed on their backs when sleeping in order to reduce the number of incidents of Sudden Infant Death Syndrome or "crib death" as it is commonly known. Complying with this advice sometimes leads to a situation where the back of the baby's head becomes flattened. Although probably not a medical condition, "flat head" syndrome may cause concern to some parents.

Although numerous pillows are available which are specifically adapted to provide additional support for infants, young children, and the like, such pillows have not been designed to reduce the pressure on the back of the head. For example, U.S. Pat. No. 4,434,513 describes a pillow referred to as a head protector which includes a panel with a U-shaped roll. In use in car-seats, infant carriers and the like, the roll is placed around the infant's head and shoulders, thereby protecting and supporting the top and sides of the infant's head. However, the back of the infant's head still experiences considerable pressure.

Hence, this invention is related to techniques for reducing or redistributing the pressure applied to the back of the head when lying in the supine position.

SUMMARY OF THE INVENTION

The invention provides exemplary pillows and methods for supporting a person's head, and especially an infant's head, when reclining in a supine position. In one embodiment such a support pillow comprises a cushion member having a support region at least partially surrounding a pressure relief region. The support region is configured to support at least a portion of the head while the pressure relief region is disposed beneath at least a portion of the back side of the head. In this way, the pressure applied to the back side of the head is reduced or is more evenly distributed than would be the case with a conventional pillow or other traditional resting surface. By reducing or more evenly applying the pressure to the back of the head in this manner, the "flat head" syndrome may be obviated or alleviated.

In one aspect, the pressure relief region may comprise a recessed portion in the cushion member. The recessed portion may be an aperture that extends completely through the cushion member or may simply be a depression, such as a concave surface, into which the back of the head rests. Conveniently, the recessed portion may have a wide variety of cross-sectional shapes, including, for example, circular, oval, elliptical, and the like, as well as shapes specifically configured according to an infant's head.

In another aspect, the length across the recessed portion may be in the range from about 2 inches to about 4 inches, and more preferably from about 2 inches to about 3 inches. Further, the support region surrounding the recessed region may have a thickness in the range from about 1 inch to about 3 inches, and more preferably from about 1.25 inch to about 2.25 inches. The size of the perimeter, the thickness, and the resiliency of the support region may be varied depending on a variety of factors, including, for example, the size and/or weight of the head, the amount of pressure applied to the head by the support region verses that applied by the pressure relief region and/or another surface onto which the head rests, and the like. In another aspect, the recessed region may have walls of various shapes, including, for example, vertical walls, tapered walls, curved walls, and the like.

In still another aspect, the pressure relief region may be less resilient that the support region. For example, the pressure relief region may be at least 10% less resilient than the support region so that more pressure is applied to the back of the head by the support region that the pressure relief region.

In one particular aspect, the cushion member includes an extended region extending from the support region. The extended region may conveniently be used to receive an infant's body. For instance, the extended region may be padded to cushion the infant's back side when lying in a supine position. Optionally, the edge of the extended region may be have a curved or scalloped design.

The cushion member may be configured in a variety of ways. For example, the cushion member may have an inclined surface for supporting an infant's body at an inclined angle. As another example, the cushion member may have an outer periphery that is circular, semicircular, rectangular or the like. As still another example, the cushion body may be ring shaped.

In one exemplary aspect, the pillow further includes an arcuate flange that is disposed around at least a portion of the pressure relief region (and may also extend around at least a portion of the support region). The flange is disposed on top of the cushion member and may be padded. The flange may be used, for example, to help prevent the infant from rolling off the pillow or to provide stability to the infant's neck when traveling.

The support pillows of the invention may be configured to be stand alone units or may be incorporated into other types of pillows/cushions, either integrally or as an add on feature. For example, the cushion member may simply be positioned beneath the user's head. Alternatively, the cushion member may have a padded extension for resting other parts of the body as previously described. As a further example, the pillow may be placed onto a fabric layer having an padded flange that is disposed about the head as previously described. Further, the support pillows of the invention, as a stand alone unit or a multi-featured system, may be used with a variety of other products which are designed to hold infants or small children. For example, the pillows may be used within cribs, strollers, swings, car seats, infant carriers, and the like.

In another embodiment, the invention provides a method for supporting an infant's head. The method utilizes a support pillow comprising a cushion member having a support region at least partially surrounding a pressure relief region. An infant is placed in a supine position, with a back of the infant's head resting on the support region. Further, at least a portion of the infant's head is disposed over the pressure relief region such that pressure applied to the back side of the head is reduced.

DESCRIPTION OF THE SPECIFIC EMBODIMENTS

Figure 1:
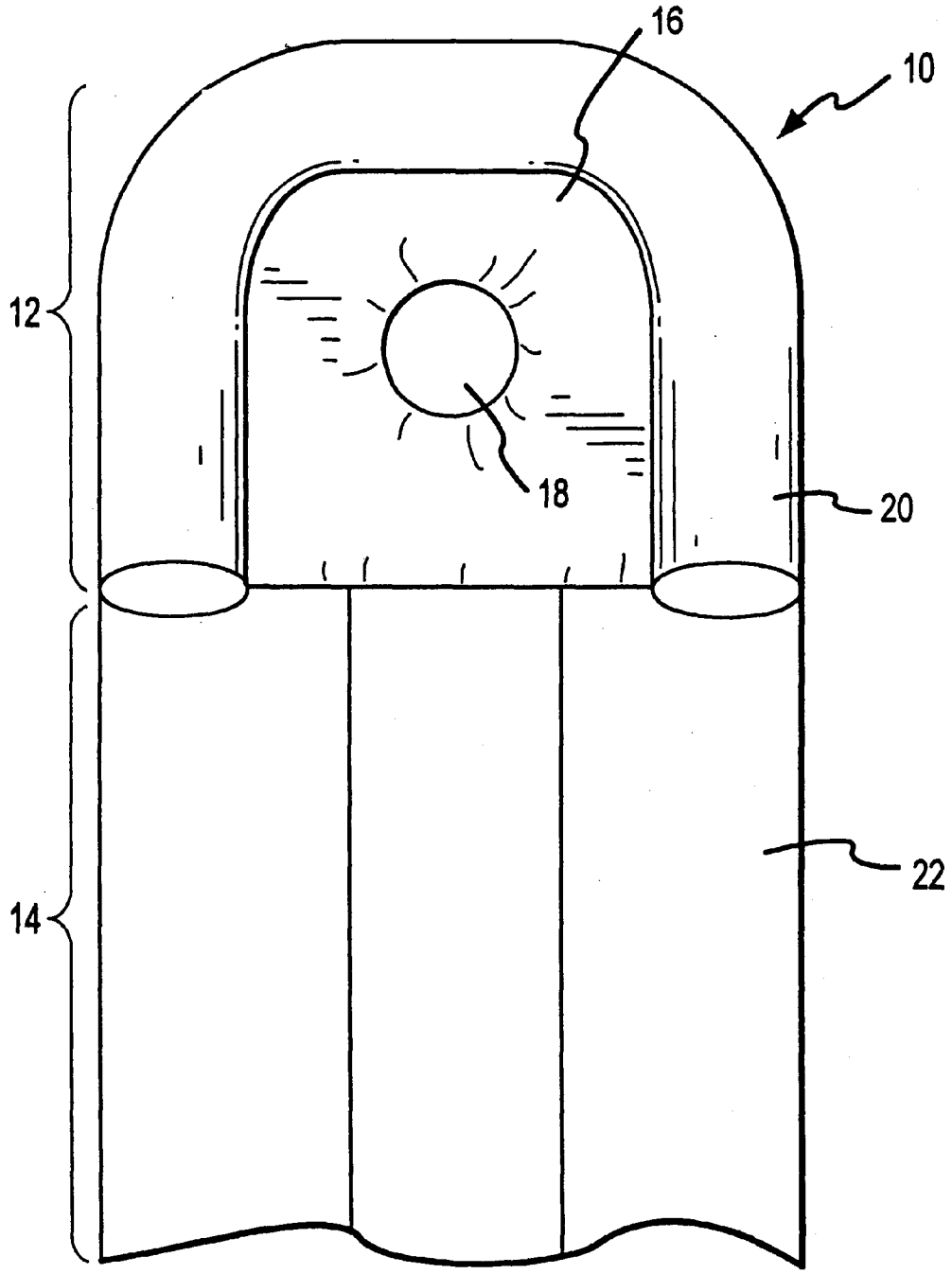
FIG. 1 is a top view of one embodiment of a support pillow according to the invention.

The invention provides exemplary pillows and methods for supporting person's head, such as an infant's head, when reclining in a supine position. The support pillows may be constructed of a generally resilient support region that at least partially surrounds a pressure relief region. In use, the back of the head rests upon the support region and is disposed over the pressure relief region. This arrangement permits a substantial amount of pressure that would otherwise be applied to a generally small region on the back of the head when lying on a generally flat and firm surface to be distributed to other locations on the head. Such a redistribution (or elimination) of pressure away from the back of the head is intended to eliminate or reduce the flattening of the back of the head that may occur over time when lying in a supine position.

The support region may be formed from a variety of resilient or "cushiony" materials. Merely by way of example, materials that may be used include inflatable bladders (such as those filled with air or other fluids), rubbers, including foamed rubber, padding, fibers, fiberballs or other fill materials, such as a polyester fill material, fabrics, small pellets, natural materials, such as feathers, seeds, hair, or the like, among others. These materials may be used alone or in various combinations.

The pressure relief region may be configured in a number of ways, such as, for example, an aperture or depression surrounded at least in part by the support region, a material that is less resilient that the support region, or the like. In use, the back of the head rests on support region and is positioned over the pressure relief region. If configured as an aperture, the back of the head may experience no pressure at this region (with the entire weight of the head being supported by the surrounding support region). Alternatively, the support region may be configured to have a certain height, outer perimeter and/or resilience so that some of the head's weight is supported by a surface positioned below the support region. In this way, a certain percentage of the weight is removed from the back of the head. In embodiments were the pressure relief region comprises a depression, such a depression may be concave or have another shape corresponding to the shape of back of head. Such a configuration is designed to more evenly distribute the pressure so as to not flatten the back of the head.

The size and shape of the outer perimeter of the pressure relief region may be varied depending on the user and/or the application. Merely by way of example, the outer perimeter may be circular, square, rectangular, elliptical, arcuate, or the like. For infants or small children, the length across the pressure relief region may be about 2 inches to about 4 inches in length, and more preferably from about 2 inches to about 3 inches. The height of the support region may be in the range from about 1 inch to about 3 inches, and more preferably from about 1.25 inch to about 2.25 inch. The height may be varied depending on the resilience of the supporting material and the configuration of the pressure relief region. Further, the inner walls of the support region may be tapered, curved, straight or the like.

The pillow having the support region and the pressure relief region may be used as a stand alone pillow or me modified to include various other peripheral features. For example, a padded extension may be included to provide padding for the back side when lying down. In another option, a head roll may be placed about the support region to support the sides of the user's head. Conveniently, the support pillows may be used in a variety of applications, including, for example, on a floor or other hard surface, in a crib or play pen, in a car set, in a stroller, in an infant carrier, in a swing, or the like.

Referring now to FIG. 1, one embodiment of a support pillow 10 will be described. Pillow 10 may conveniently be described in terms of a head portion 12 and a body portion 14. Head portion 12 is designed to receive the back of the user's head and comprises a support region 16 and a pressure relief region 18. Support region 16 may conveniently be constructed by stuffing a fill material between pieces of fabric in a manner similar to a conventional pillow. However, other resilient materials may also be used as previously described. Support region 16 includes a central aperture that extends through support region 16. This aperture defines pressure relief region 18. Partially surrounding support region 16 is an arcuate padded roll 20. Roll 20 fits snugly around the user's head and serves to support the user's neck as well as to prevent the user from rolling off of pillow 10. Extending from support region 16 is a padded extension 22 that defines body portion 14. Padded extension 22 may conveniently be formed by placing a fill material between fabric pieces, and may be used to provide padding to the user's back when lying in a supine position. Seams may be sewn into the fabric to prevent shifting of the fill material. Conveniently, roll 22 and extension 22 may be similar to the configuration described in U.S. Pat. No. 4,434,513, incorporated herein by reference.

Figure 2:
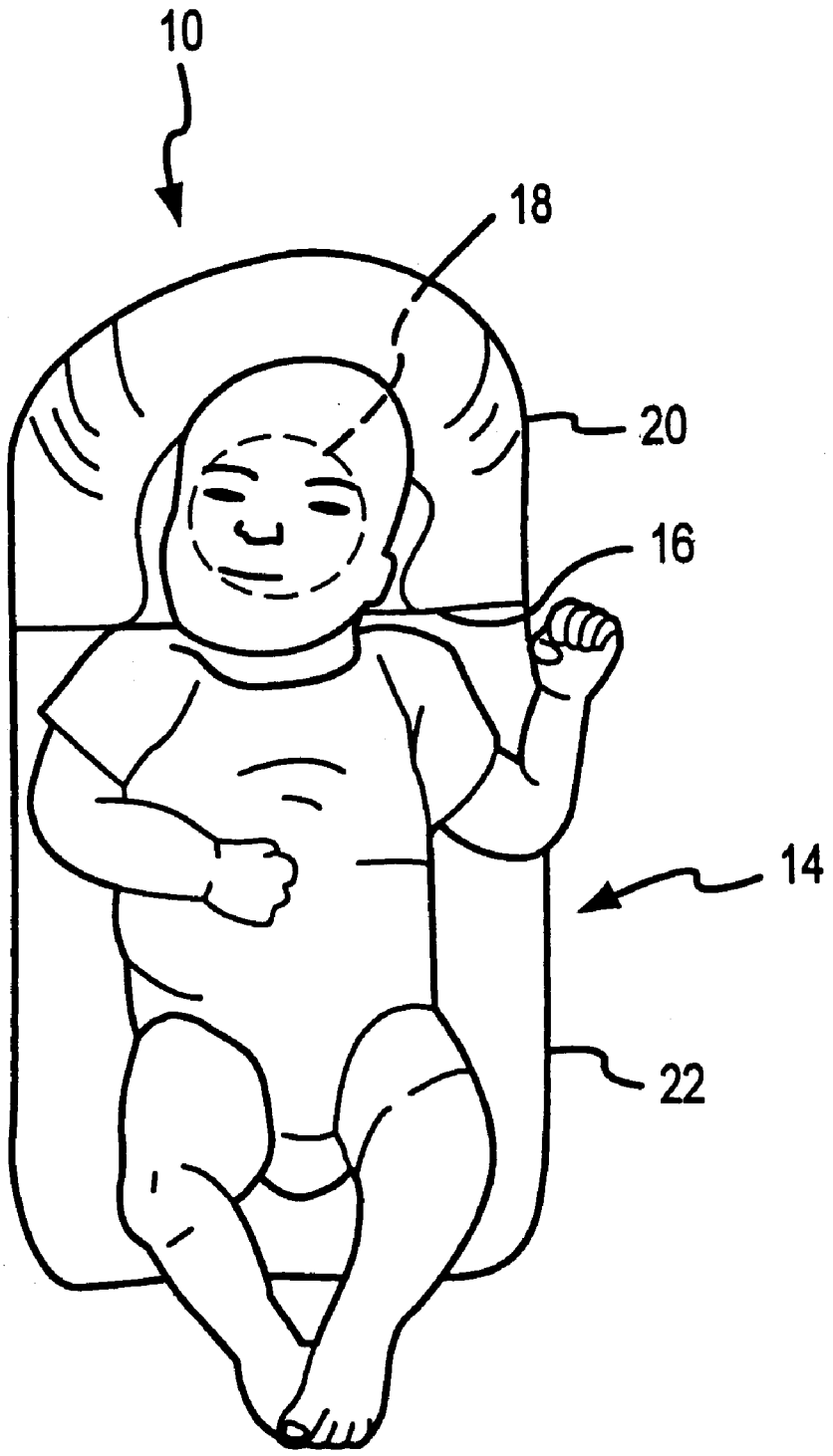
FIG. 2 is a schematic representation of an infant reclining in a supine position on the pillow of FIG. 1.

In use, an infant may be placed onto pillow 10, with the infant's head being surrounded by roll 22, and the infant's back and legs resting on extension 22 as shown in FIG. 2. The back of the infant's head fits within the aperture defined by pressure relief region 18. The sides of the head rest upon support region 18. Depending on the resilience of support region 16, its height, and the shape and size of the aperture, the back of the head may rest upon a surface below pillow 10, or may be suspended above the surface. In this way, the pressure applied to the back of the head is greatly reduced or eliminated to prevent flattening of the back of the head, as well as providing additional comfort to the infant.

Pillow 10 may be used in a variety of settings. For example, pillow 10 may simply be placed onto the floor or other hard surface. Pillow 10 may also be used with a variety of infant products, such as car seats, baby carriers, strollers, swings, cribs, play pens, and the like.

Figure 3:
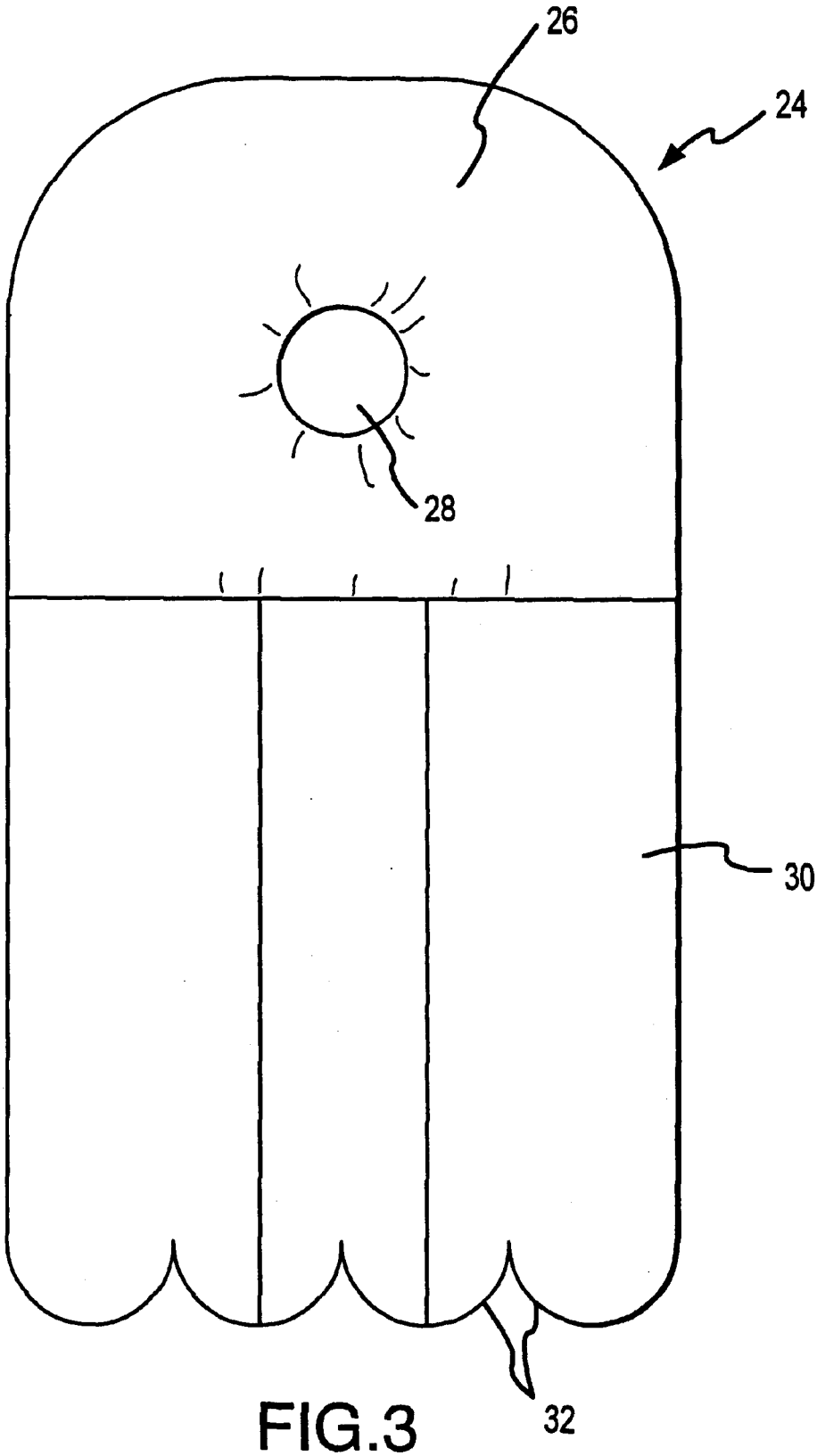
FIG. 3 is a top view of an alternative support pillow according to the invention.

FIG. 3 illustrates a support pillow 24 having a support region 26, a pressure relief region 28, and a padded extension 30 that are similar to those previously described in connection with FIG. 1. The bottom edge of extension 30 conveniently includes scallops 32. Pillow 24 is advantageous in that it may be used as an insert into various other infants products, especially those having a head roll or protector. For example, pillow 24 may be placed on top of the pillow described in U.S. Pat. No. 4,434,513, previously incorporated by reference. In this way, existing products may easily be retrofit with a pillow that prevents flattening of the head.

Figure 4:
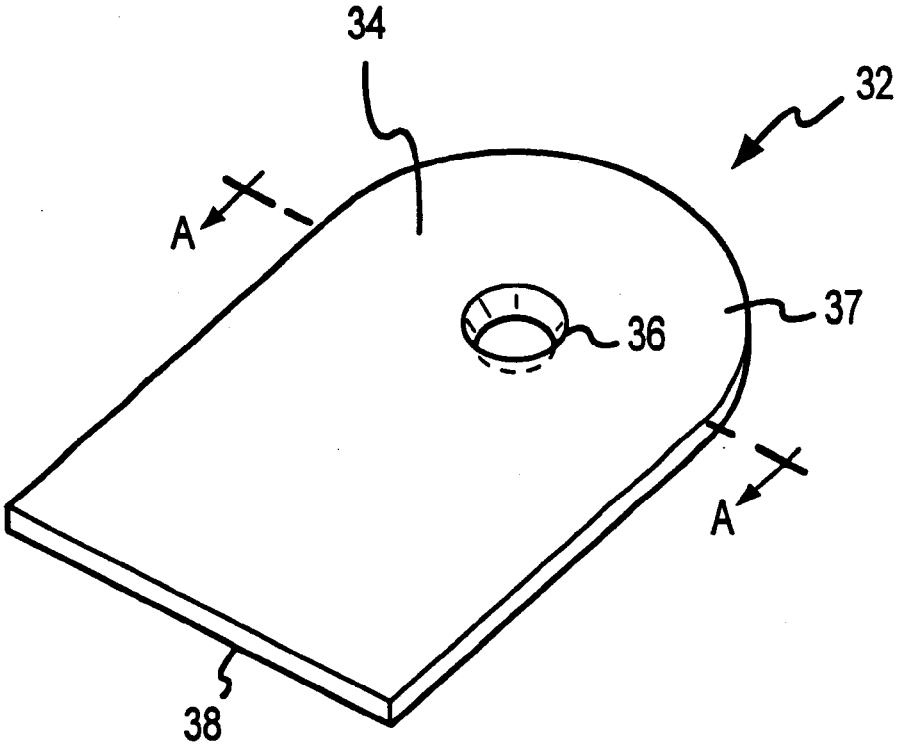
FIG. 4 is a top perspective schematic view of another embodiment of a pillow according to the invention.

FIG. 4 illustrates another embodiment of a pillow 32 that comprises a resilient support member 34 having an aperture 36 that extends through support member 34. Support member 34 has a top end 37 and a bottom end 38 and may conveniently be constructed of a foamed material. Top end 37 serves as a support for the head. Bottom end 38 may extend to the user's neck, or along the length of the user's body. In this way, pillow 32 may be used as a stand alone pillow, or may be tailored in size and used as an insert into another infant product in a manner similar to that previously described.

In use, the back of the head is received in aperture 36. As shown, aperture 36 has a circular cross-section. The diameter of aperture 36 is not so big that the infant's head can pass through the aperture. At the same time, the diameter of the aperture may be at least about 2 inches in size in order to adequately relieve the pressure applied to the back center of the head.

Figure 4A:
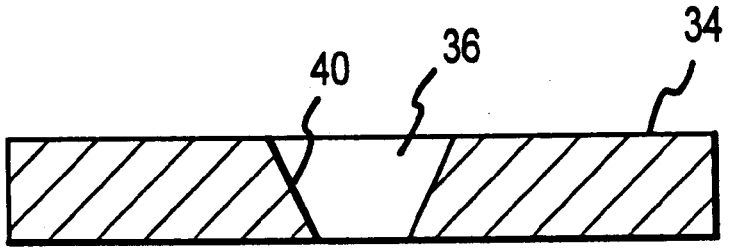
FIG. 4A is a cross section side view of the pillow of FIG. 4 taken along lines A—A.

As shown in FIG. 4A, aperture 36 has a tapered wall 40. This provides an increased surface area to distribute the pressure applied to the sides of the head. However, it will be appreciated that other configurations may be used, such as curved walls, straight walls, and the like.

Figure 5:
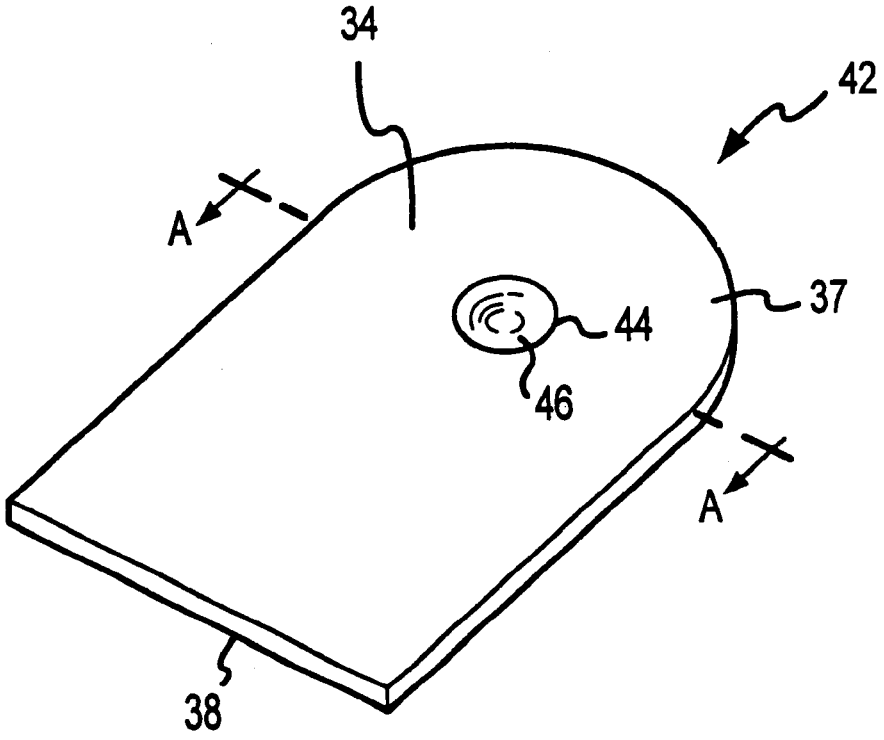
FIG. 5 is a top perspective schematic view of another embodiment of a pillow according to the invention.
Figure 5A:
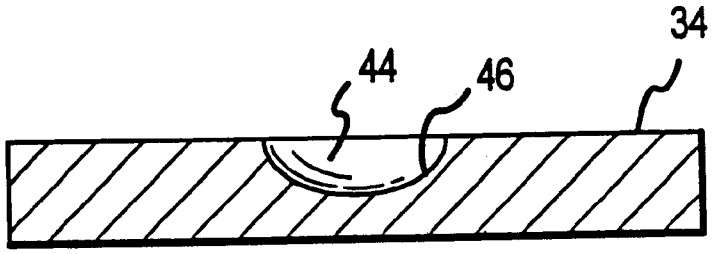
FIG. 5A is a cross section side view of the pillow of FIG. 5 taken along lines A—A.

FIG. 5 illustrates another embodiment of a pillow 42 that is similar to pillow 32. For convenience of discussion, similar elements are labeled with the same reference numerals used in FIG. 4. Instead of having an aperture, pillow 42 utilizes a depression 44 as a pressure relief region. Depression 44 has a concave surface 46 (see FIG. 5A) upon which the center of the back of the head rests. Concave surface 46 conforms to the shape of the back of the head to evenly distribute the applied pressure over the head. In this way, the applied pressure is not centralized and reduces the chances that the head will flatten.

Figure 6:
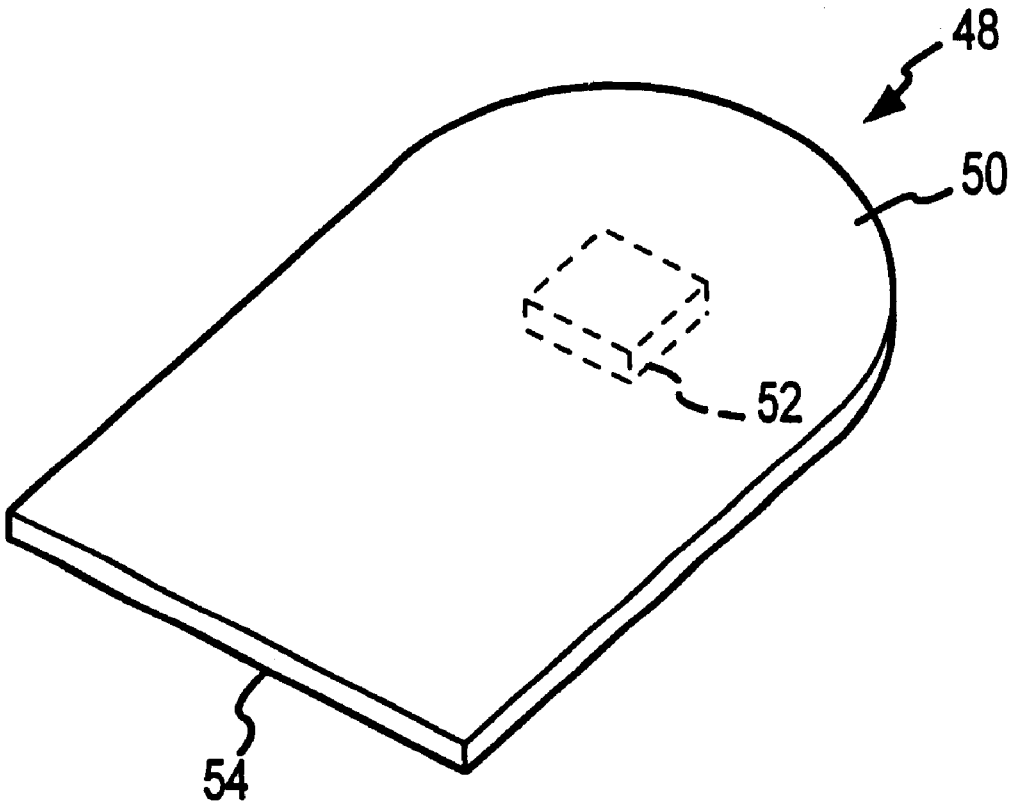
FIG. 6 is a top schematic view of yet another embodiment of a pillow of the present invention.

FIG. 6 illustrates a pillow 48 having a resilient support member 50 that may be similar to the support members of FIGS. 4 and 5. Pillow 48 further includes a pressure relief region 52 that comprises a material having less resilience than the resilience of support member 50. For example, pressure relief region 52 may be formed of a softer material, or even the same material weakened by perforations. In use, the back center of the user's head is supported by the pressure relief region 52. Being of lower resilience, region 52 will more readily adopt the profile corresponding to the natural curvature of the infant's head than other parts of the support surface. In this way, the applied pressure is distributed to a larger area, thereby preventing flattening of the head. Conveniently, pillow 48 includes a rounded side 54 spaced furthest from the region 52.

Figure 7:
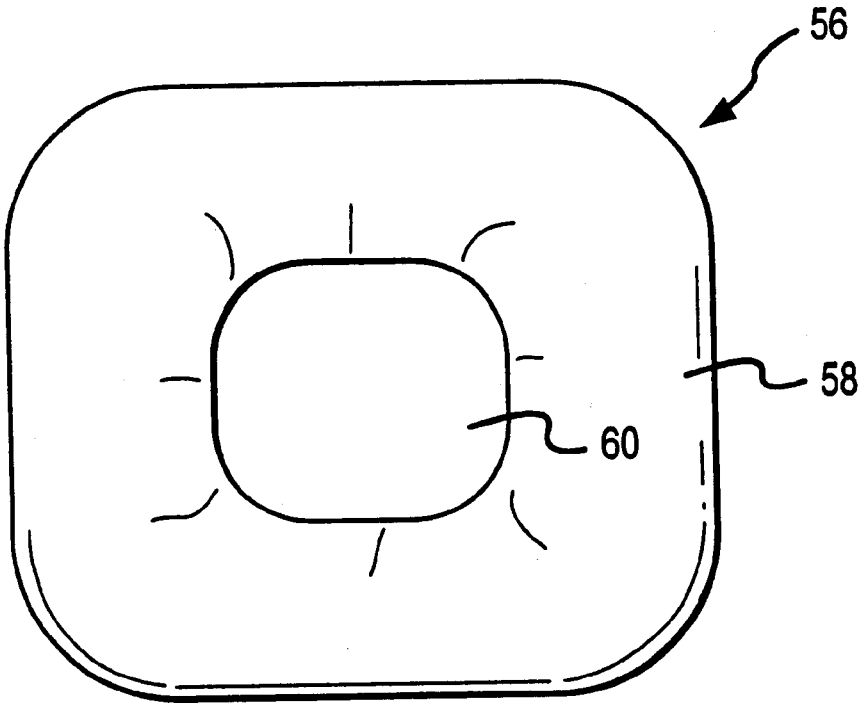
FIG. 7 is a top view of still another embodiment of a pillow of the present invention.
Figure 7A:
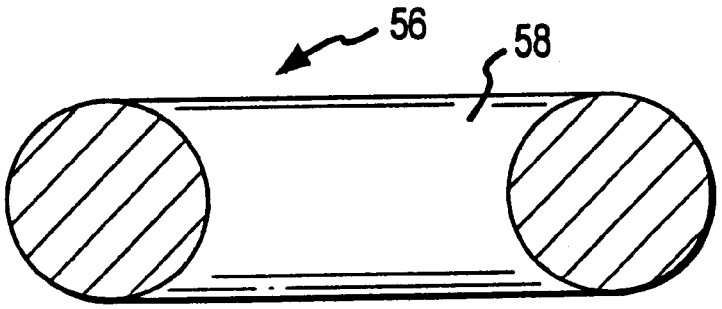
FIG. 7A is a cross sectional side view of the pillow of FIG. 7.

FIGS. 7 and 7A illustrate a support pillow 56 that is in the shape of a doughnut. Pillow 56 comprises a support region 58 and an aperture 60 that serves as a pressure relief region. Pillow 56 may conveniently be constructed of a fill material that is stuffed between fabric pieces.

In use, the user may place his or her head on pillow 56, with the back of the head resting within aperture 60. Pillow 56 may be used as a stand alone pillow or may be used as an insert with other infant products in a manner similar to that previously described.

Figure 8:
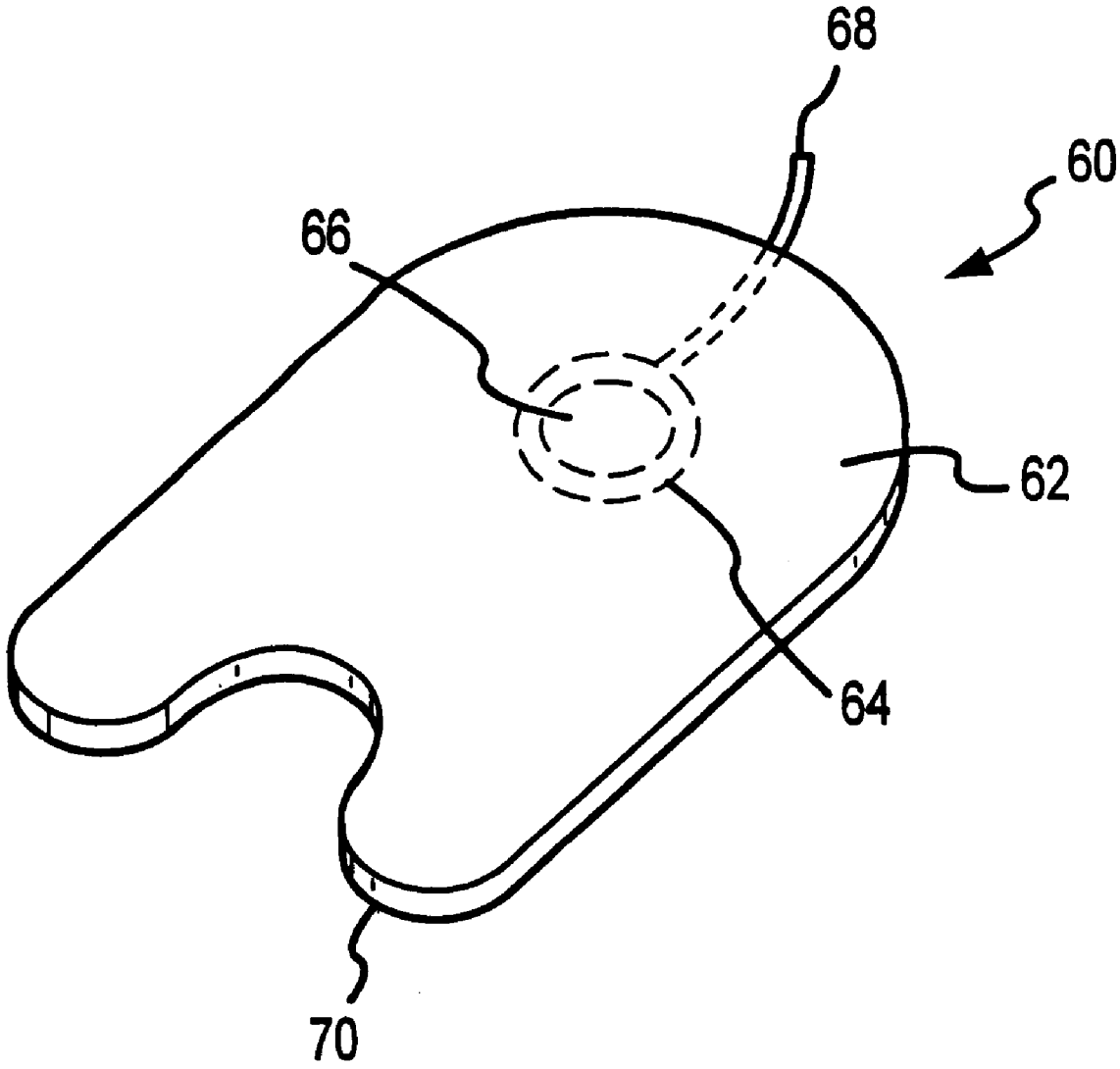
FIG. 8 is a schematic representation of one particular embodiment of a pillow of the present invention.

Referring to FIG. 8, a pillow 60 comprises a support member 62 which has an embedded ring-shaped insert 64. Insert 64 has an opening 66 that serves as a pressure relief region. The ring-shaped insert 64 comprises an inflatable bladder which has a valve 68 through which air may be introduced or removed to inflate or deflate the insert 64. Accordingly, part of the infant's head will, in use, be supported over the opening 66. As such, the pressure applied to the back of the head will be reduced. Support member 62 may optionally include a scalloped side 70 spaced furthest from the insert 64.

Figure 9:
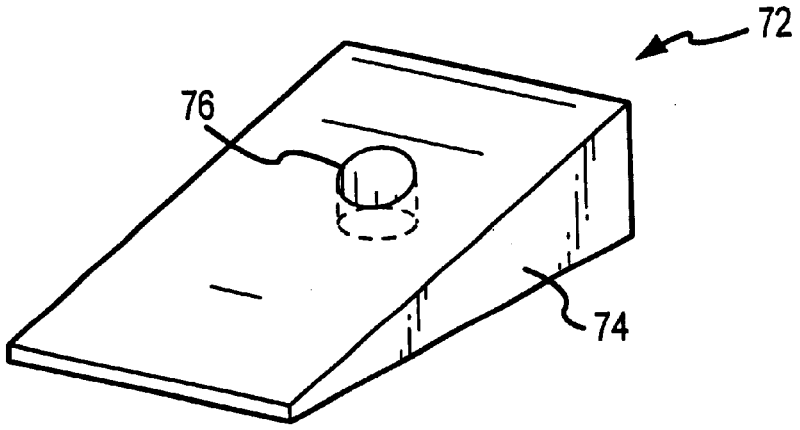
FIG. 9 is a schematic representation still another embodiment of a pillow of the present invention.

Referring to FIG. 9, a pillow 72 comprises a wedge-shaped cushion member 74 which has an aperture 76 extending through cushion member 74. Cushion member 74 may conveniently be constructed of a foamed material. Alternatively, cushion member may include a depression or a region of lesser resilience. In use, cushion member 74 permits the user to lie at an incline, with the back of the head being over aperture 76. In this way, the pressure applied to the back of the head is reduced.

Figure 10:
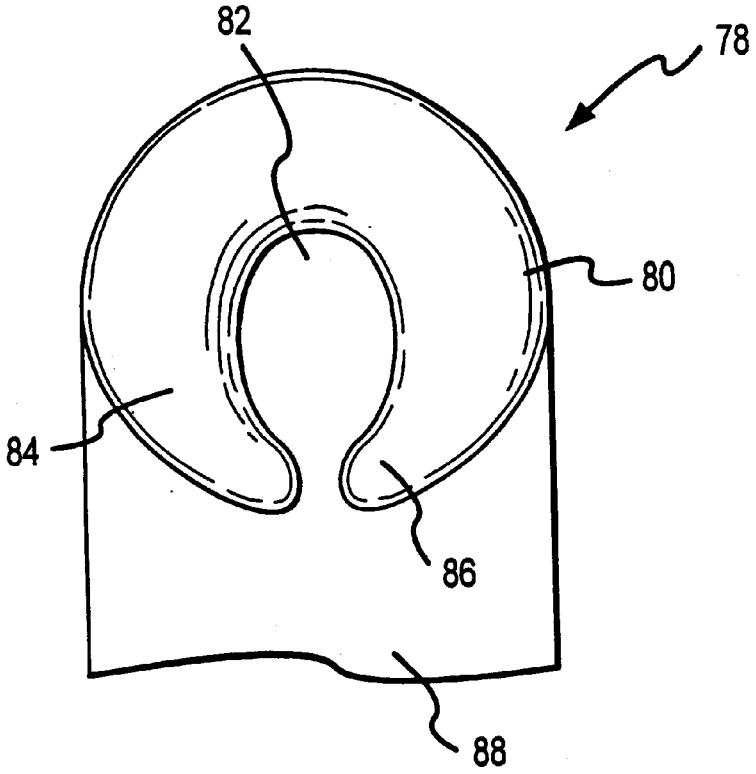
FIG. 10 is a top view of one particular embodiment of a support pillow according to the invention.

Referring to FIG. 10, a support pillow 78 comprises a horseshoe-shaped cushion member 80. Conveniently, cushion member 80 may be constructed in a manner similar to that described in U.S. Pat. No. 5,261,134, the complete disclosure of which is herein incorporated by reference. Cushion member defines a central opening 82 and includes a pair of arms 84 and 86. Cushion member 80 is disposed on top of a resilient pad 88.

In use, a person lies in a supine position, with the head of the head resting within opening 82. Cushion member 80 supports the side of the head, and arms 84 and 86 extend to the neck to provide neck support. In this way, the amount of pressure applied to the back of the head is reduced. Further, pad 88 provides a convenient resting place for the user's back.

The invention has now been described in detail for the purposes of clarity of understanding. However, it will be appreciated that certain changes and modifications may be practiced within the scope of the appended claims.

What is claimed is:

1. A support pillow for supporting a head or a person when in a supine position, the support pillow comprising:

a cushion member having a padded support region at least partially surrounding a pressure relief region, wherein the support region is generally flat and the pressure relief region is generally flush with or recessed relative to the support region;

wherein the support region is configured to support at least a portion of a head, and wherein the pressure relief region is configured to receive at least a portion of a back side of the head such that pressure applied to the back side of the head is reduced when lying in a supine position; and an arcuate flange disposed on the cushion member.

2. A pillow according to claim 1, wherein the pressure relief region comprises a recessed portion in the cushion member.

3. A pillow according to claim 2, wherein the recessed portion comprises an aperture extending through the cushion member.

4. A pillow according to claim 2, wherein the recessed potion has a cross-sectional shape that is selected from a group consisting of a circle, an oval, an ellipse and combinations thereof.

5. A pillow according to claim 2, wherein the recessed portion has a length across in the range from about 2 inches to about 3 inches.

6. A pillow according to claim 2, wherein the recessed portion is inwardly tapered.

7. A pillow according to claim 2, wherein the support region surrounding the recessed region has a thickness in the range from about 1 inch to about 3 inches.

8. A pillow according to claim 1, wherein the pressure relief region is less resilient that the support region.

9. A pillow according to claim 8, wherein the pressure relief region is at least 10% less resilient than the support region.

10. A pillow according to claim 1, wherein the cushion member includes an extended region extending from the support region, wherein the extended region is adapted to receive an infant's body.

11. A pillow according to claim 10, wherein the extended region is padded.

12. A pillow according to claim 11, wherein the extended region includes a curved edge.

13. A pillow according to claim 12, wherein the curved edge is scalloped.

14. A pillow according to claim 1, wherein the cushion member has an inclined surface for supporting an infant's body at an inclined angle.

15. A pillow according to claim 1, wherein the cushion member has an outer periphery having a geometry that is selected from a group consisting of a circular geometry, a semicircular geometry, and a rectangular geometry.

16. A pillow according to claim 1, wherein the arcuate flange is padded.

17. A pillow according to claim 1, wherein the cushion member is ring-shaped in geometry.

18. A support pillow system comprising:

a padded member;

a support pillow operable with the padded member, the support pillow comprising a support region at least partially surrounding a pressure relief region, wherein the support region is generally flat and the pressure relief region is generally flush with or recessed relative to the support region;

wherein the support region is configured to support at least a portion of a head, and wherein the pressure relief region is configured to receive at least a portion of a back side of the head such that pressure applied to the back side of the head is reduced when resting on the support region.

19. A system according to claim 18, wherein the padded member comprises an arcuate flange disposed about a periphery of the support region.

20. A system as in claim 19, further comprising a seating device that is adapted to receive the padded member and the support pillow.

21. A method of supporting an infant's head, the method comprising:

providing a support pillow comprising a cushion member having a support region at least partially surrounding a pressure relief region, wherein the support region is generally flat and the pressure relieve region is generally flush with or recessed relative to the support region;

placing an infant in a supine position, with a back of the infant's head resting on the support region, and with at least a portion of the infant's head being disposed over the pressure relief region such that pressure applied to the back side of the head is reduced; and placing a padded member about the infant's head.

* * * * *